United States Patent [19]

Vinzant et al.

[11] Patent Number: 4,723,606

[45] Date of Patent: Feb. 9, 1988

[54] SURFACE CONTROLLED SUBSURFACE SAFETY VALVE

[75] Inventors: Michael B. Vinzant, Carrollton; Phillip S. Sizer, Dallas; Ronald K. Churchman; Rennie L. Dickson, both of Carrollton; Roddie R. Smith, Plano, all of Tex.

[73] Assignee: Otis Engineering Corporation, Dallas, Tex.

[21] Appl. No.: 3,181

[22] Filed: Jan. 13, 1987

Related U.S. Application Data

[63] Continuation of Ser. No. 827,433, Feb. 10, 1986, abandoned.

[51] Int. Cl.[4] ..... E21B 34/10

[52] U.S. Cl. ..... 166/319; 166/332

[58] Field of Search ..... 166/319–323, 166/332–334, 374, 375, 381, 386, 387, 206, 207, 212, 214, 215, 123

[56] References Cited

U.S. PATENT DOCUMENTS

| | | | |
|---|---|---|---|
| 3,786,865 | 1/1974 | Tausch et al. | 166/321 X |
| 3,882,935 | 5/1975 | Calhoun | 166/323 X |
| 3,981,358 | 9/1976 | Watkins et al. | 166/323 |
| 4,310,051 | 1/1982 | Mott | 166/323 |
| 4,344,602 | 8/1982 | Arendt | 166/323 X |
| 4,378,931 | 4/1983 | Adams, Jr. | 166/322 |
| 4,417,600 | 11/1983 | Kohn | 166/334 X |
| 4,427,175 | 1/1984 | Adams, Jr. | 166/332 X |
| 4,449,587 | 5/1984 | Rodenberger et al. | 166/332 X |
| 4,469,179 | 9/1984 | Crow et al. | 166/323 X |
| 4,479,539 | 10/1984 | Tamplen et al. | 166/212 |
| 4,624,315 | 11/1986 | Dickson et al. | 166/323 |

*Primary Examiner*—Stephen J. Novosad
*Assistant Examiner*—Thuy M. Bui
*Attorney, Agent, or Firm*—Thomas R. Felger

[57] ABSTRACT

A surface controlled subsurface safety valve for use in a well tubing string including a valve closure member, an operator tube for opening the valve closure member and holding it open, an annular piston on the operator tube operative in response to control fluid pressure conducted from the well surface, a spring biasing the operator tube to a position at which the valve is closed, and a lockout sleeve mounted in tandem with the operator tube for movement simultaneously with the operator tube to a position at which the lockout sleeve holds the valve open. The operator tube and lockout sleeve are engageable by a shifting tool to operate the operator tube and lockout sleeve simultaneously. The lockout sleeve can be returned to an inoperative position by control fluid pressure moving the operator tube to a position which opens the valve closure member. The safety valve is also operable by a modified shifting tool engaging the operator tube. The shifting tool includes selective keys and separate expandable latch dogs for simultaneous coupling of the operator tube and the lockout sleeve.

22 Claims, 22 Drawing Figures

SURFACE CONTROLLED SUBSURFACE SAFETY VALVE

This is a continuation of copending application Ser. No. 06/827,433 filed Feb. 10, 1986 now abandoned.

BACKGROUND OF THE INVENTION

This invention relates to surface controlled subsurface safety valves used in the oil and gas industry and particularly including a mechanism for temporarily locking the valves open and for remedial cycling of the valves.

DESCRIPTION OF RELATED ART

It is common practice to complete oil and gas producing wells with systems including a subsurface safety valve controlled from the well surface to shut off fluid flow in the well tubing string. Generally such a valve is controlled in response to control fluid pressure conducted to the valve from a remote location at the well surface via a small diameter conduit permitting the well to be selectively shut in as well conditions require. However, the present invention is not limited to use with safety valves that respond only to fluid pressure signals. The surface controller is typically equipped to respond to emergency conditions such as fire, broken flow lines, oil spills, etc. Frequently it is necessary to conduct well servicing operations through a subsurface safety valve. When a safety valve malfunctions, it may be necessary to install a second safety valve. In any event, it may be desirable to either permanently or temporarily lock the safety valve open. For example, if the well servicing operation requires extending a wireline tool string through the subsurface safety valve, it is preferable to use a lock open system which is not dependent upon control fluid pressure from the well surface. When operations are being carried out through an open subsurface safety valve such as pressure and temperature testing, it can be extremely expensive and time-consuming for a valve to accidentally close on the supporting wireline causing damage to the wireline and sensing apparatus supported therefrom. Additional well servicing procedures are required to retrieve the damaged equipment. Subsurface safety valves including both a permanent and a temporary lock open mechanism are shown in the following U.S. Pat. Nos. 3,786,865; 3,882,935; 4,344,602; 4,356,867; and 4,449,587. The present invention particularly relates to a subsurface safety valve of the type shown in U.S. Pat. Nos. 3,786,865 and 4,449,587 employing a temporary lockout arrangement for the flapper type of valve closure included in the subsurface safety valves. The previously listed patents are incorporated by reference for all purposes in this application. Copending U.S. patent application Ser. No. 06/658,275 filed on Oct. 5, 1984 now U.S. Pat. No. 4,624,315 is directed towards solving some of the same problems as the present invention.

SUMMARY OF THE INVENTION

The present invention relates primarily to tubing retrievable flapper type safety valves having a housing connectable with a well tubing string and a bore therethrough for communicating well fluid flow with the tubing string, a flapper valve mounted in the housing for movement between a first open position and a second closed position, and an operator tube in the housing to shift the flapper valve between its second position and its first position. The operator tube normally moves in response to a control signal from the well surface, but a shifting tool can releasably engage the operator tube for movement independent of the control signal. A lockout sleeve may be mounted in the housing in tandem with the operator tube for movement between a first position engaging and holding the flapper valve open and a second position of disengagement from the flapper valve. A shifting tool is also provided having selective locating keys and latch dogs for releasably coupling with the operator tube and the lockout sleeve, respectively. An alternative embodiment of the present invention can be used with any type of surface controlled subsurface safety valve to cycle the valve closure mechanism if it is stuck or the control signal is inoperative.

It is a principal object of the present invention to provide a subsurface safety valve for use in oil and gas wells including a lockout sleeve for temporarily holding or locking open the safety valve during well servicing operations.

It is another object of the invention to provide a subsurface safety valve having an operator tube and a lockout sleeve with a shifting tool latching the operator tube and sleeve together during movement of the sleeve to a position in which the sleeve holds the valve closure mechanism of the subsurface safety valve open.

It is another object of the invention to provide a subsurface safety valve having a lockout sleeve which has a smooth, uniform inside diameter to minimize the possibility of other well tools accidentially shifting the lockout sleeve.

It is another object of the invention to provide a subsurface safety valve including a temporary lockout sleeve wherein the shifting tool does not engage the inside diameter of the temporary lockout sleeve to move the sleeve.

It is another object of the invention to provide a subsurface safety valve including an operator tube which may be operated by an alternative shifting tool to check the proper functioning and full travel of the operator tube of the safety valve.

Still another object of the invention is to provide a subsurface safety valve including a modified operator tube and an alternative shifting tool which may be used to move the operator tube of the valve to free the operator tube or valve closure means when jammed by sand or other well debris.

Additional objects and advantages of the present invention will be apparent to those skilled in the art from studying the following detailed description in conjunction with the accompanying drawings in which several preferred embodiments of the invention are shown.

DESCRIPTION OF THE PREFERRED EMBODIMENT

Figure 1:
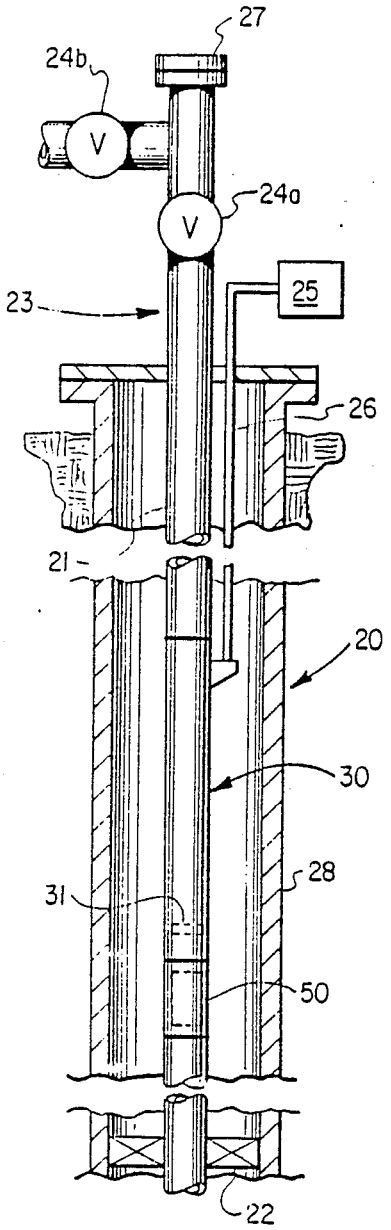
FIG. 1 is a schematic view in section and elevation of a typical well completion including a tubing retrievable subsurface safety valve with a flapper type valve closure means.

Referring to FIG. 1, well completion 20 includes casing string 28 extending from the well surface to a hydrocarbon producing formation (not shown). Tubing string 21 is concentrically disposed within casing 28 and extends from wellhead 23 through production packer 22 which seals between tubing string 21 and casing 28. Packer 22 directs formation fluids such as oil, gas, water, and the like into tubing string 21 from perforations (not shown) in casing 28 which admit formation fluids into the well bore. Flow control valves 24*a* and 24*b* at the well surface control fluid flow from tubing string 21. Wellhead cap 27 is provided on wellhead 23 to permit servicing well 20 via tubing string 21 by wireline techniques which include the installation and removal of various flow control devices such as valves from within tubing string 21. Other well servicing operations which may be carried out through tubing string 21 are bottom hole temperature and pressure surveys.

Surface controlled subsurface safety valve 30 embodying the features of the invention is installed in well 20 as a part of tubing string 21 to control fluid flow to the well surface via tubing string 21 from a downhole location. Safety valve 30 is operated by control fluid conducted from hydraulic manifold 25 at the well surface via control line conduit 26 which directs the control fluid signal to safety valve 30. Hydraulic manifold 25 generally includes pumps, a fluid reservoir, accumulators, and control valves for the purpose of providing control fluid pressure signals for holding valve 30 open or allowing valve 30 to close when desired. Manifold 25 also includes apparatus which functions in response to temperature, surface line leaks, and other emergency conditions under which well 20 should be shut in.

Safety valve 30 includes flapper type valve closure means 31 mounted by hinge 34 for swinging between a closed position schematically represented in FIG. 1 and an open position which permits fluid flow in tubing string 21. When a predetermined pressure signal is applied to safety valve 30 through control line 26 from manifold 25, valve closure means 31 is maintained in its first or open position. When the control pressure signal is released, valve 30 is allowed to move to its second or closed position. In accordance with the invention, lockout sleeve 50 is provided in valve 30 for movement between a first position which holds valve closure means 31 open and a second position in which valve closure means 31 is free to open or close. With flapper 31 restrained open by lockout sleeve 50, various well servicing operations may be conducted without fear of inadvertent closure of valve 30 which can be damaging to the servicing equipment.

Details of the construction of the preferred form of valve 30 and lockout sleeve 50 are shown in FIGS. 2A–D. Shifting tool 70 for operating lockout sleeve 50 illustrated in FIGS. 3A–B will also be described in detail. Subsurface safety valve 30 has housing means 60 formed by a top sub 61*a*, a bottom sub 61*b*, and interconnected housing subassemblies 62, 63, 64, 65, and 66 which are suitably interconnected by threaded joints as illustrated. Housing means 60 can be generally described as a long thick walled cylinder with longitudinal bore 67 extending therethrough. The top and bottom subs 61*a* and 61*b* may be internally or externally threaded to provide means on opposite ends of housing means 60 for connection with tubing string 21 as represented in FIG. 1. Top sub 61*a* includes locking grooves 68 machined on its inside diameter. Locking grooves 68 provide means for installing a secondary or retrievable safety valve (not shown) within longitudinal bore 67 if safety valve 30 should become inoperative. The secondary valve may be designed to operate in response to the same control signal as safety valve 30 or may be designed to respond directly to changing well conditions.

Housing subassembly 62 has threaded connection 29 to allow attaching control line 26 to safety valve 30. Control fluid pressure signals are communicated from the well surface via control line 26, threaded connection 29, passageway 81, and opening 82 to longitudinal bore 67. Cylinder 83 is positioned within longitudinal bore 67 adjacent to opening 82. During normal operation of safety valve 30, control fluid pressure signals are directed to operator tube 40 via annular passageway 84 formed between the inside diameter of housing subassembly 62 and the outside diameter of cylinder 83.

Permanent lockout sleeve 80 is slidably disposed within longitudinal bore 67. Permanent lockout sleeve 80 is sized to fit concentrically within cylinder 83. During normal operation of safety valve 30, knockout plug 85 holds permanent lockout sleeve 80 in its inactive position shown in FIG. 2A. If safety valve 30 should become inoperative, profile 86 on the inside diameter of permanent lockout sleeve 80 can be engaged by a suitable shifting tool (not shown) to force sleeve 80 into abutting contact with operator tube 40 and to open safety valve 30. Movement of sleeve 80 causes knockout plug 85 to shear, allowing communication of control fluid pressure signals therethrough. Snap ring 87 is carried by housing subassembly 62 within longitudinal bore 67 to lock sleeve 80 in place after it has moved. Matching teeth 88 are carried on the outside diameter of sleeve 80 and the inside diameter of snap ring 87. The use of locking recesses 68, permanent locking sleeve 80, and associated components to install a secondary safety valve within longitudinal bore 67 is well known in the art.

Figure 2A:
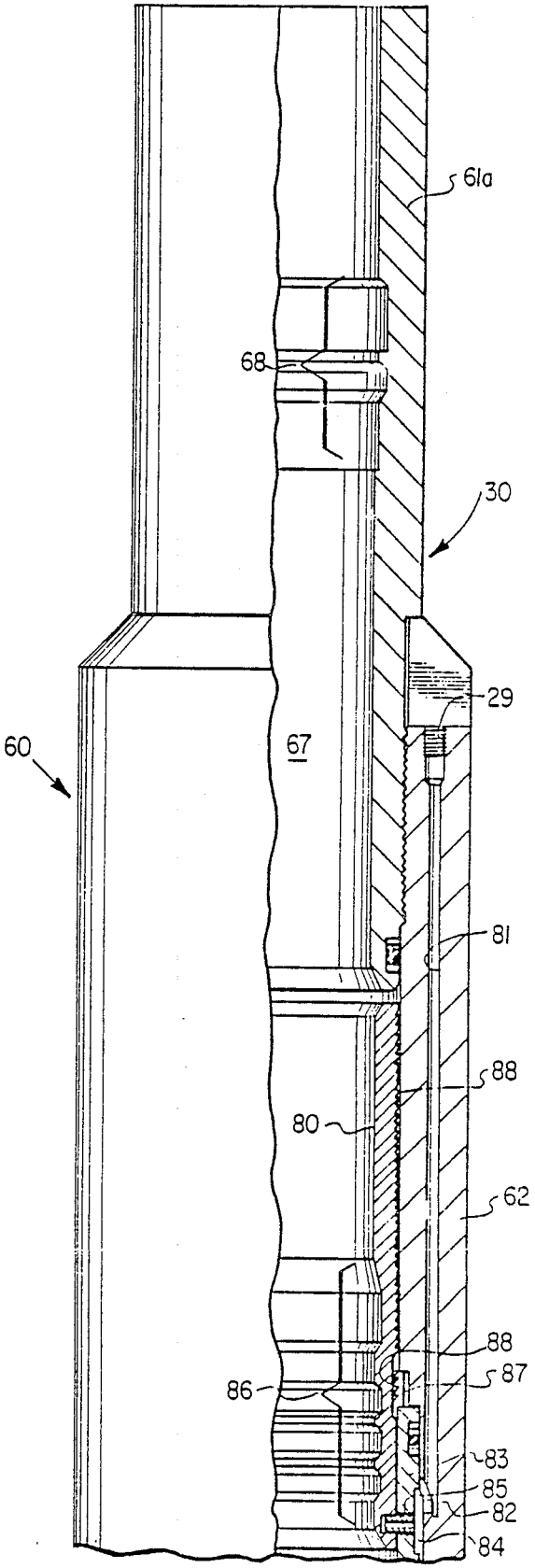
FIGS. 2A, 2B, 2C, and 2D taken together form a longitudinal view, in section and elevation with portions broken away, of a subsurface safety valve and lockout sleeve incorporating the present invention showing the safety valve in its open position.
Figure 2B:
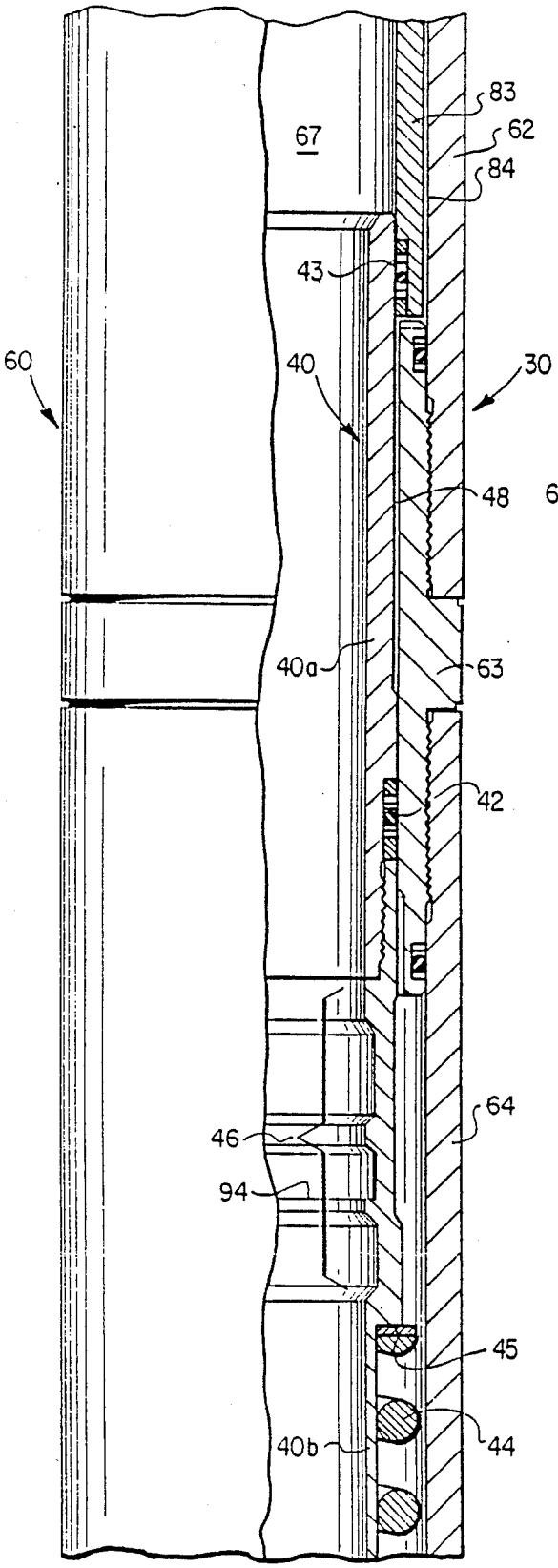
Figure 2C:
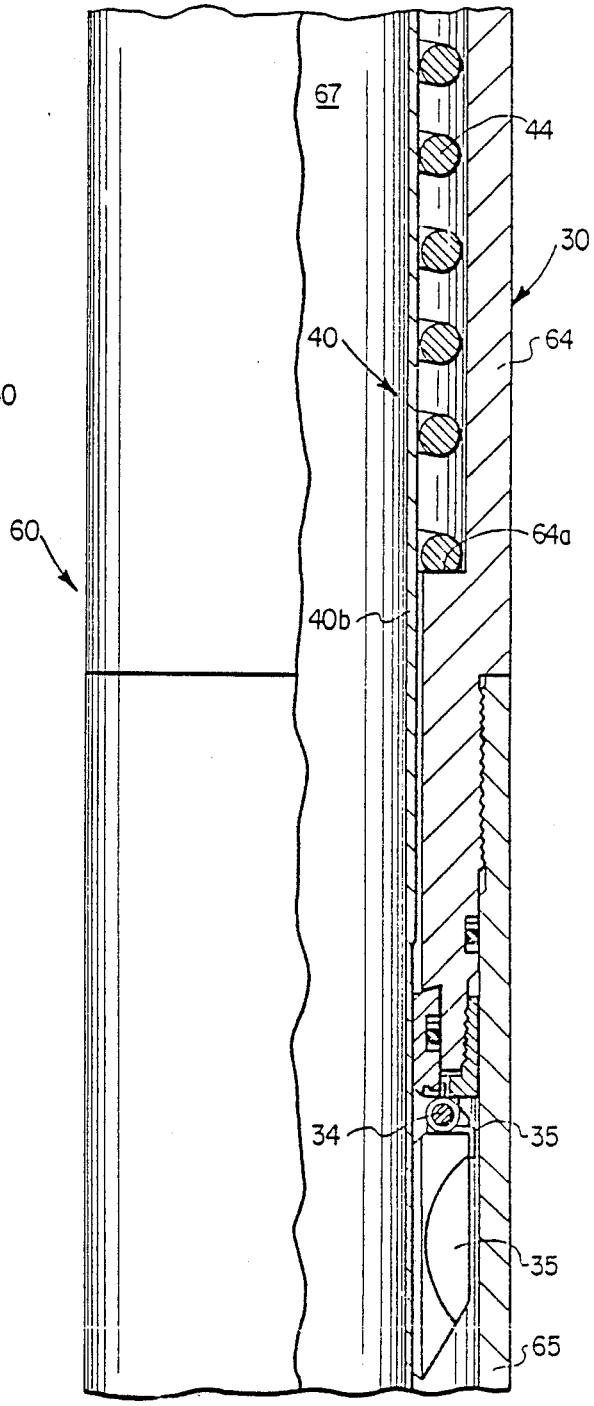

Operator tube 40 is slidably disposed within longitudinal bore 67 to shift valve closure means 31 from its second, closed position to its first, open position as shown in FIG. 2C. For ease of manufacture and assembly, operator tube 40 is constructed from two generally hollow, cylindrical subassemblies designated 40*a* and 40*b*. Subassemblies 40*a* and 40*b* are joined together by threaded connection 41. Piston seal means 42 is carried on the exterior of operator tube 40 to form a sliding fluid barrier with the inside diameter of housing subassembly 63 adjacent thereto. Seal means 43 is carried by cylinder 83 to form a fluid barrier with the exterior of operator tube 40. Stationary seal means 43, movable piston seal means 42, and the exterior of operator tube 40 therebetween define in part variable volume control fluid chamber 48. Control fluid pressure from annular passageway 84 is received within chamber 48 to act upon piston seal means 42 and to longitudinally slide operator tube 40 towards valve closure means 31 in response thereto. Biasing means or spring 44 is carried on the exterior of operator tube 40 between shoulder 64*a* on the inside diameter of housing subassembly 64 and shoulder 45 on the exterior of operator tube 40. Biasing means 44 applies a force to shift operator tube 40 longitudinally opposite from control fluid pressure in chamber 48. When control fluid pressure in chamber 48 is decreased below a preselected value, spring 44 moves operator tube 40 longitudinally upward to allow valve closure means 31 to return to its closed position. Spring 35 coiled around hinge 34 also assists in moving flapper 31 to its closed position.

Selective key profile 46 is formed on the interior of operator tube 40 intermediate the ends thereof. Profile 46 provides means for releasably engaging operator tube 40 with a shifting tool whereby the shifting tool can move operator tube 40 independent of the control signal. The use of shifting tools 70, 170, and 270 with respect to profile 46 and operator tube 40 will be described later in detail. The configuration and dimensions of profile 46 are selected to be different from locking recess 68 and profile 86. Therefore, operator tube 40 can be engaged only by a shifting tool having selective keys which match profile 46.

Figure 2D:
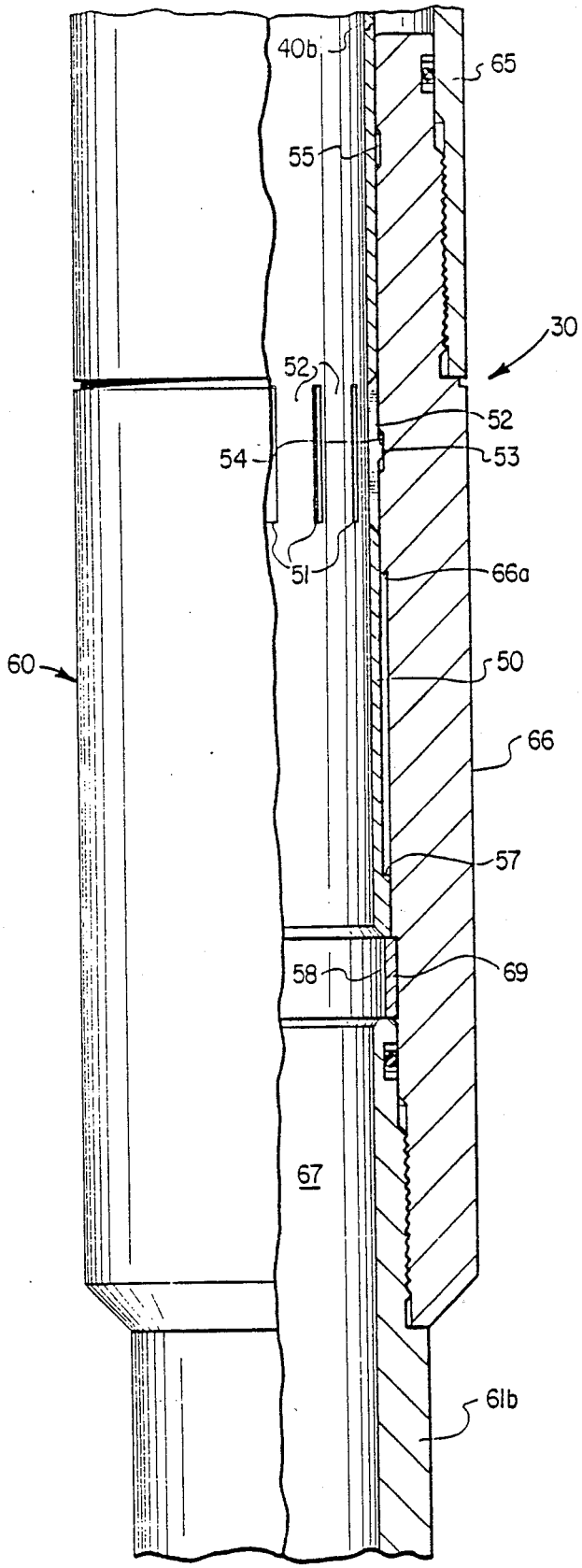
Figure 8:
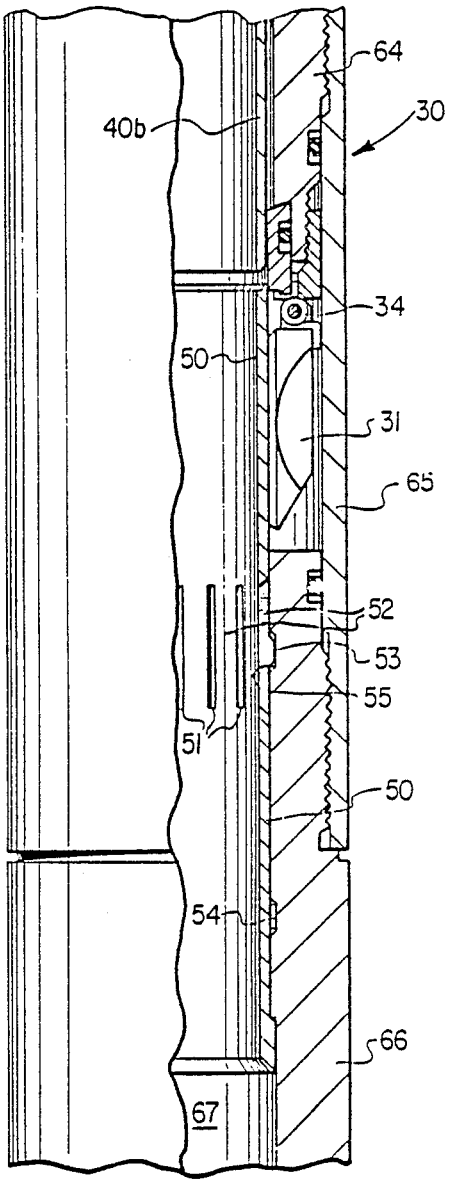
FIG. 8 is a view similar to FIGS. 7B and C showing the valve closure means temporarily locked open with the shifting tool removed.

A second lockout sleeve designated 50 is slidably disposed in housing means 60 in tandem with operator tube 40. In comparison to first lockout sleeve 80, second sleeve 50 can be classified as a temporary lockout device. Lockout sleeve 50 has a first position shown in FIG. 8 which holds valve closure means 31 in its first position and a second position shown in FIG. 2D which does not restrict movement of valve closure means 31 between its first and second positions. As shown in FIGS. 2D and 8, lockout sleeve 50 has a relatively smooth, uniform inside diameter. Therefore, it is difficult for a wireline tool to accidentally engage lockout sleeve 50 and shift it to an undesired position. The smooth, uniform inside diameter of lockout sleeve 50 is an important feature of the present invention.

A plurality of longitudinal slots 51 are machined through sleeve 50 intermediate the ends thereof. Slots 51 are circumferentially spaced to provide a plurality of collet fingers 52. An external boss 53 is provided on each collet finger 52. Internal grooves 54 and 55 are provided on the interior of housing subassembly 66 to receive bosses 53 therein. Grooves 55 and 54 are spaced longitudinally from each other to correspond respectively with the first position and second position for lockout sleeve 50. Collet fingers 52, bosses 53, and grooves 54 and 55 cooperate to provide means for releasably holding lockout sleeve 50 in its first or second position.

Longitudinal movement of lockout sleeve 50 within longitudinal bore 67 is limited by shoulder 66*a* on the interior of housing subassembly 66 contacting shoulder 57 on the exterior of sleeve 50 and by sleeve 50 resting on spacer ring 69. As best shown in FIG. 2D, the inside diameter of spacer ring 69 is larger than either sleeve 50 or housing subassembly 61*b*. Spacer ring 69 is used to define recess 58 in housing means 60 below lockout sleeve 50. It will be explained later how recess 58 is used to shift lockout sleeve 50 to its first position.

Figure 3A:
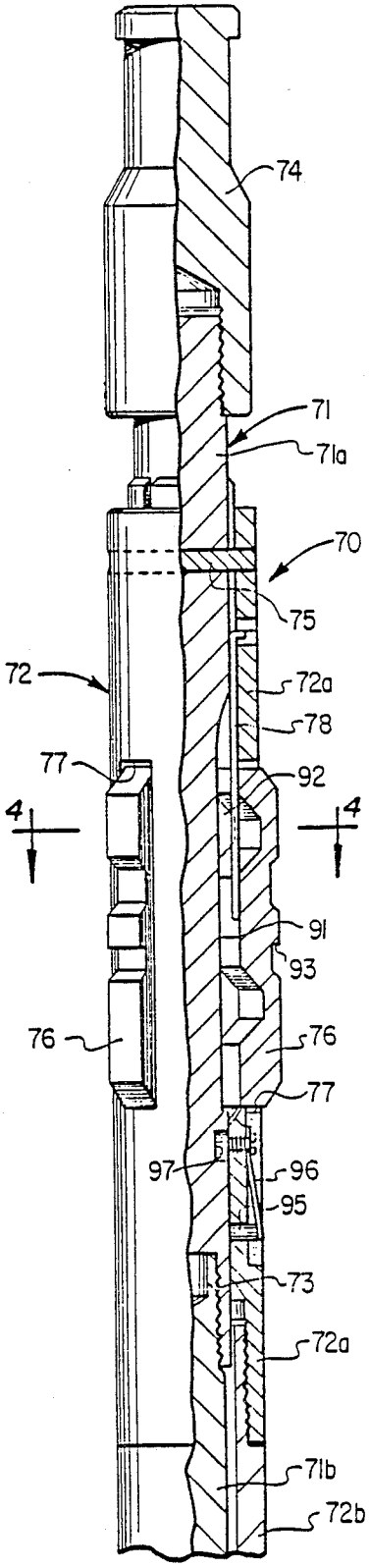
FIGS. 3A and 3B taken together form a longitudinal view, in section and elevation with portions broken away, of one embodiment of the shifting tool of the present invention.
Figure 3B:
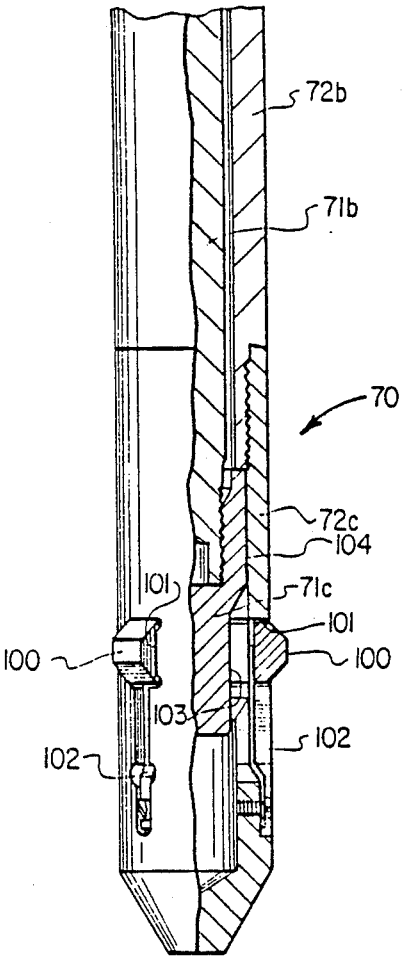
Figure 4:
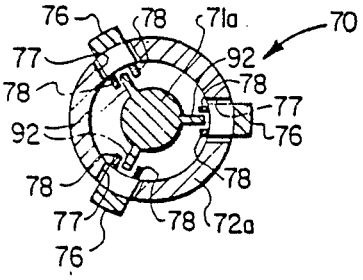
FIG. 4 is a drawing in section taken along line 4—4 of FIG. 3.

Shifting tool 70, shown in FIGS. 3A and B, is used to shift lockout sleeve 50 from its second to its first position. Shifting tool 70 is adapted for insertion into longitudinal bore 67 by use of conventional wireline techniques. Shifting tool 70 has an inner mandrel or core means 71 slidably disposed within cylindrical housing means 72. For ease of manufacture and assembly, core means 71 comprises several subsections 71*a*, b, and c. Subsections 71*a* and b, two generally solid, cylindrical rods, are connected to each other by threads 73. Fishing neck 74 is provided on the end of subsection 71*a* extending from housing means 72. Fishing neck 74 provides means for attaching shifting tool 70 to a conventional wireline tool string (not shown).

Housing means 72 comprises several generally hollow, cylindrical subsections designated 72*a*, b, and c which are attached to each other by appropriate threaded connections. During initial insertion of shifting tool 70 into longitudinal bore 67, first releasable means or shear pin 75 extends through both core means 71 and housing means 72 as shown in FIG. 3A to prevent undesired relative longitudinal movement therebetween.

A plurality of selective keys 76 are disposed within windows 77 extending through housing subsection 72*a*. Leaf springs 78 are carried on the inside diameter of subsection 72*a* adjacent to selective keys 76. Springs 78 are designed to project keys 76 radially outward through windows 77. Core means 71 has reduced diameter portion 91 which allows keys 76 to be compressed radially inward by restrictions in either tubing string 21 or safety valve 30. Shear pin 75 is used to hold reduced diameter portion 91 radially adjacent to keys 76 during insertion of tool 70. A plurality of bosses 92 are provided on reduced diameter portion 91 adjacent to each key 76. Bosses 92 and the interior of keys 76 are designed to allow inward compression of keys 76 when shear pin 75 is installed.

Figure 5A:
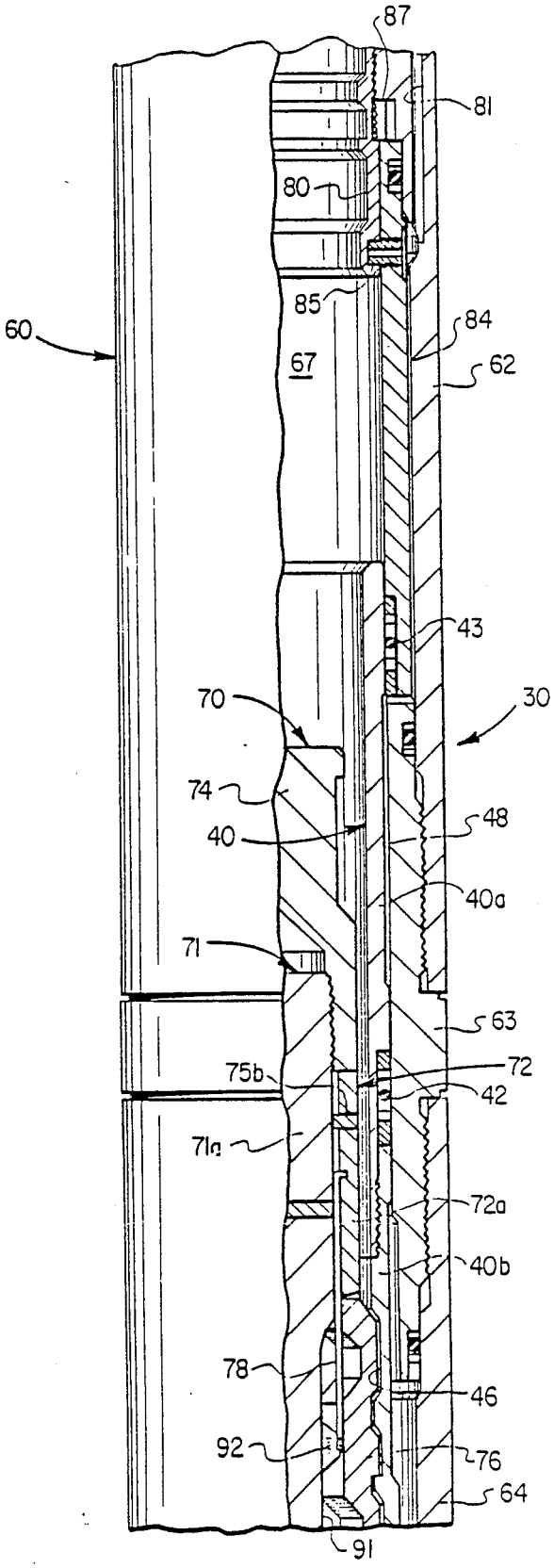
FIGS. 5A, 5B, and 5C taken together form a longitudinal view in section and elevation showing the safety valve of FIGS. 2A–D with the valve closure means open, the lockout sleeve of the safety valve in its inoperative position, and the shifting tool of FIG. 3 engaged therewith.
Figure 5B:
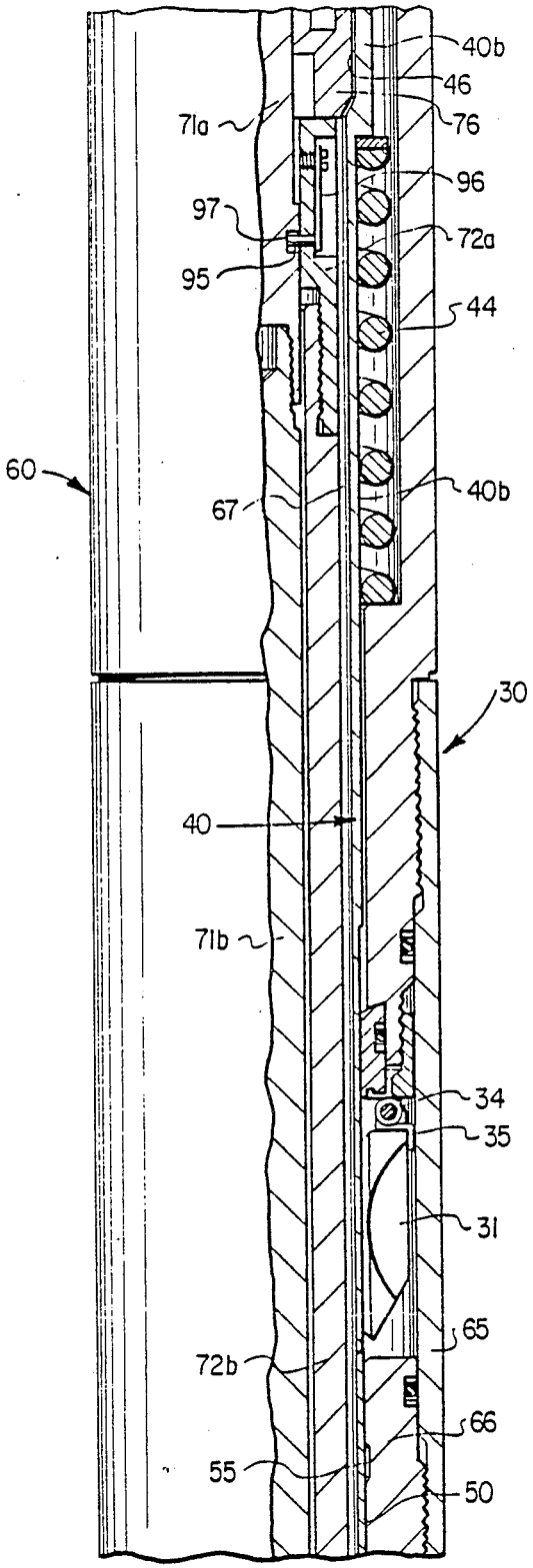
Figure 5C:
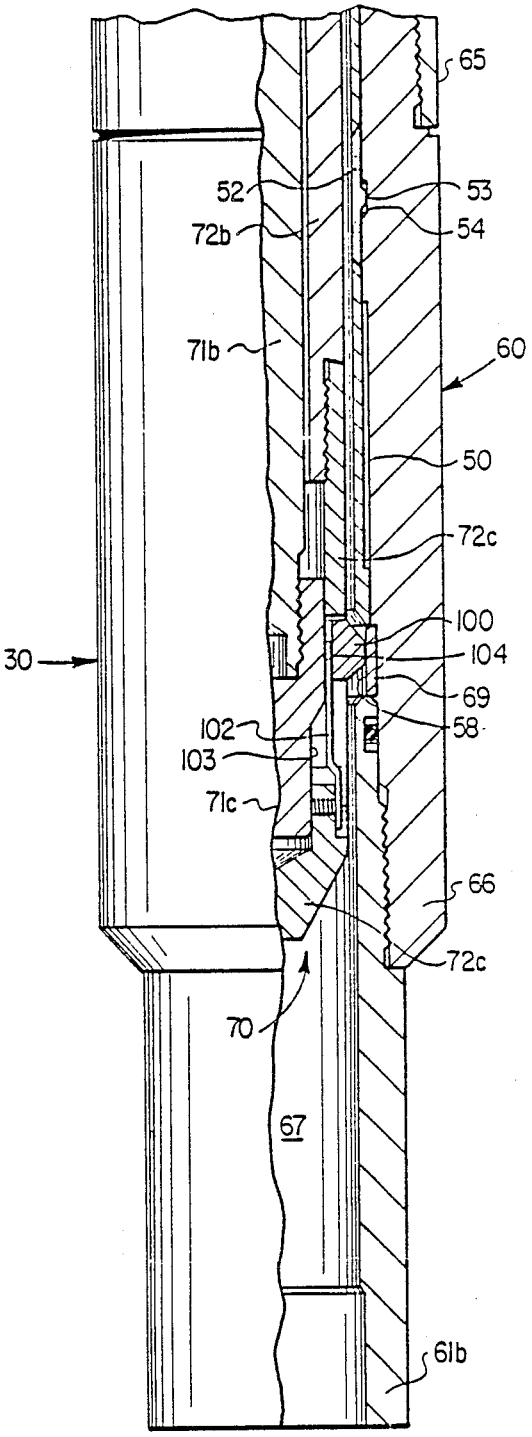

Keys 76 have an exterior profile which matches profile 46 of operator tube 40. Engagement of keys 76 with profile 46 prevents further downward movement of shifting tool 70 relative to safety valve 30 due to square shoulders 93 and 94. Force can then be applied to core means 71 to shear pin 75 and slide core means 71 longitudinally relative to housing means 72. This longitudinal movement positions bosses 92 radially adjacent to and contacting a portion of their respective key 76 to lock keys 76 radially projected as shown in FIG. 5A.

Second shear pin 95 is carried by housing subsection 72*a* and biased radially inward by leaf spring 96. The exterior of core means 71 has annular groove 97 formed on its exterior. The location of annular groove 97 is selected so that shear pin 75 will normally hold groove 97 spaced longitudinally from second shear pin 95. When core means 71 moves relative to housing means 72, groove 97 is designed to be engaged by second shear pin 95. Groove 97 and shear pin 95 cooperate to provide second releasable means for preventing undesired relative movement between core means 71 and housing means 72 to hold keys 76 radially expanded.

Shifting tool 70 has a plurality of latching dogs 100 spaced longitudinally from selective keys 76. Latching dogs 100 are slidably disposed within second windows 101 of housing subsection 72c. A leaf spring 102 is provided to project each dog 100 radially outward. Inner core means section 71c has a reduced diameter portion 103 which allows dogs 100 to be compressed radially inward by restrictions in tubing string 21 including portions of safety valve 30. Dogs 100 are specifically sized to fit within recess 58 below lockout sleeve 50.

Shear pin 75 normally holds reduced diameter portion 103 radially adjacent to dogs 100. When pin 75 is sheared, core means 71 can move longitudinally to position enlarged outside diameter portion 104 of subsection 71c radially adjacent to dogs 100. Enlarged portion 104 prevents dogs 100 from flexing radially inward. Second shear pin 95 and annular groove 97 cooperate to lock dogs 100 radially expanded.

Operating Sequence

For purposes of describing the operation of this invention, it will be assumed that safety valve 30 is installed in a well completed as shown in FIG. 1. Control fluid pressure is communicated from manifold 25 via control line 26 to housing means 60 of safety valve 30. Using standard well servicing techniques and surface wireline equipment (not shown), shifting tool 70 is introduced into tubing string 21 via wellhead cap 27.

In FIGS. 5A, B, and C, safety valve 30 is shown in its first position with control fluid pressure in chamber 48 acting on operator tube 40 to hold flapper 31 open. A wireline tool string (not shown) would be attached to fishing neck 74 to manipulate shifting tool 70 within longitudinal bore 67. Selective keys 76 are engaged with profile 46 in operator tube 40 to prevent further downward movement of shifting tool 70 relative to safety valve 30. This engagement allows force to be applied to fishing neck 74 by the wireline tool string to shear pin 75 into two pieces 75a and b as shown in FIG. 5A. The force applied to fishing neck 74 causes inner core means 71 to slide longitudinally downward until fishing neck 74 rests on the top of housing means 72. This downward movement of core means 71 will position bosses 92 behind their respective keys 76 and enlarged outside diameter portion 104 behind dogs 100. Leaf spring 96 will force shear pin 95 into annular recess 97 which locks keys 76 and latching dogs 100 radially expanded.

Figure 6A:
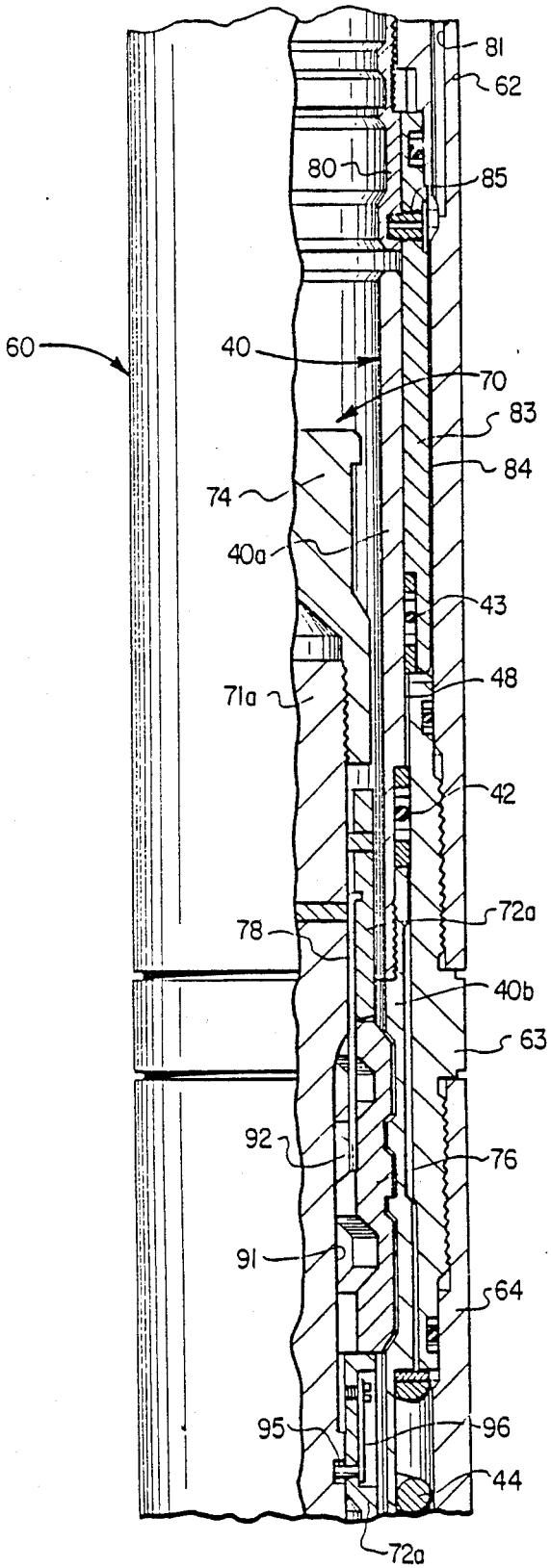
FIGS. 6A, 6B, and 6C taken together form a view similar to FIGS. 5A, 5B, and 5C showing the shifting tool and the safety valve after shifting the lockout sleeve to hold open the valve closure means.
Figure 6B:
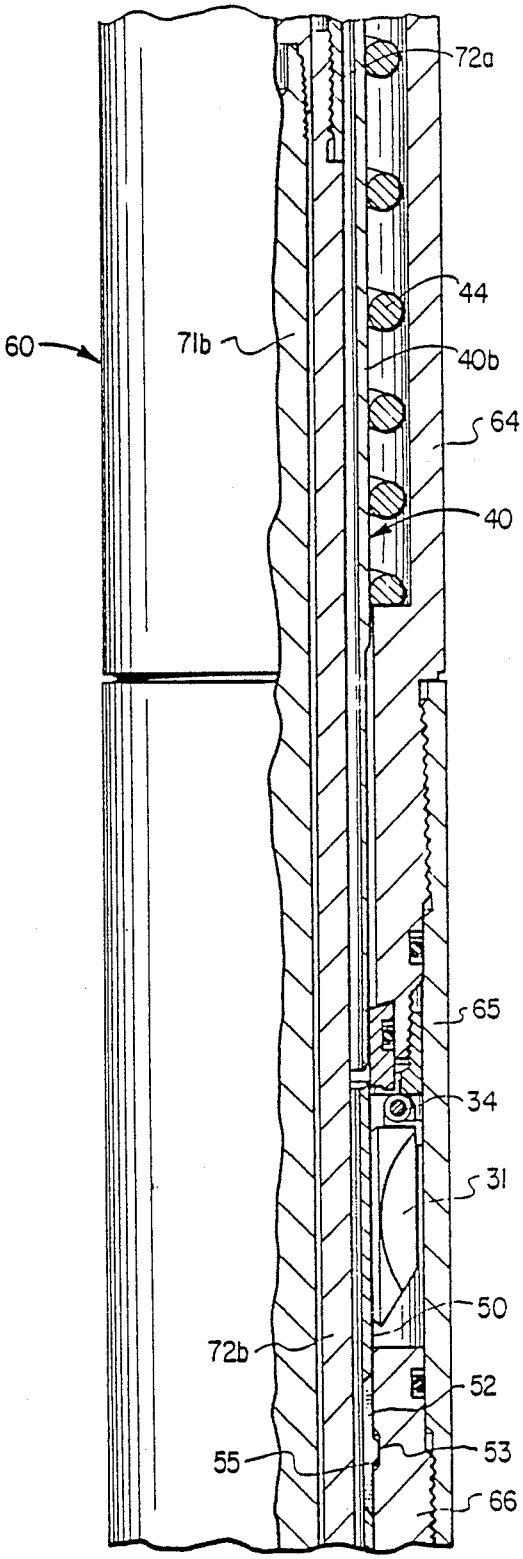
Figure 6C:
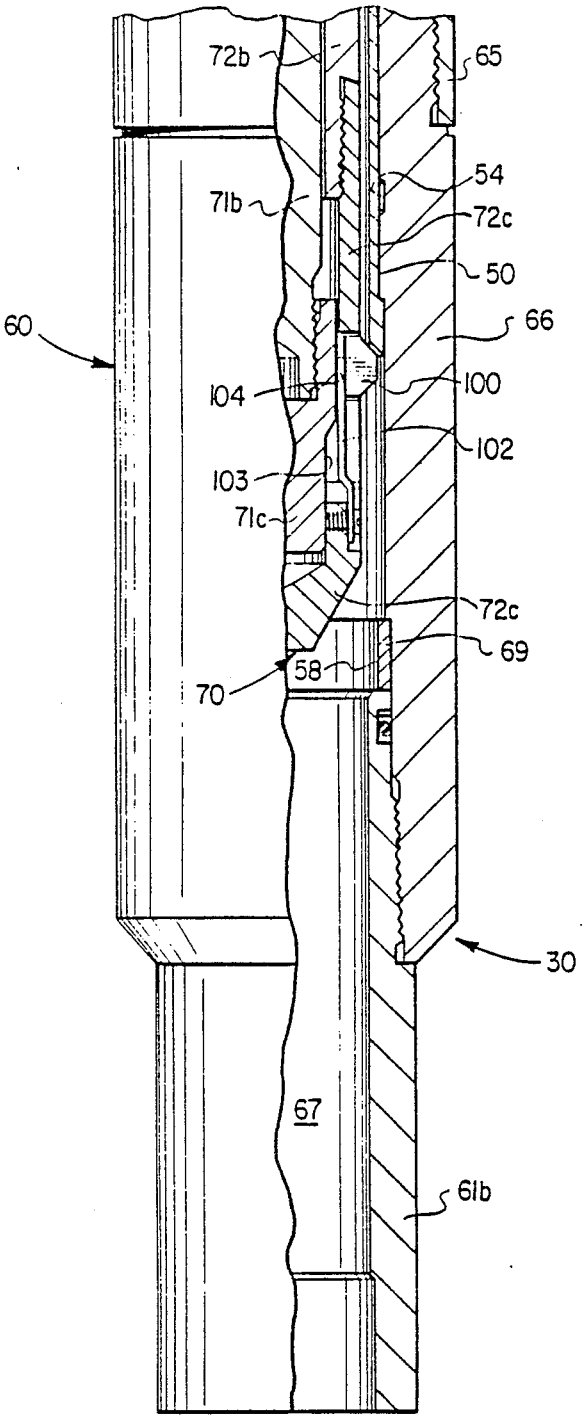

With safety valve 30 and shifting tool 70 positioned as shown in FIGS. 5A, B, and C, the next step towards temporarily locking open safety valve 30 is to decrease control fluid pressure in chamber 48 below a preselected value. Since keys 76 are locked into profile 46 and latching dogs 100 locked outward into recess 58, operator tube 40 and lockout sleeve 50 must move in unison. Force can be applied to shifting tool 70 via the wireline attached to fishing neck 74 to assist spring 44 in shifting operator tube 40 to its second position and lockout sleeve 50 to its first position as shown in FIG. 6A, B, and C.

Figure 7A:
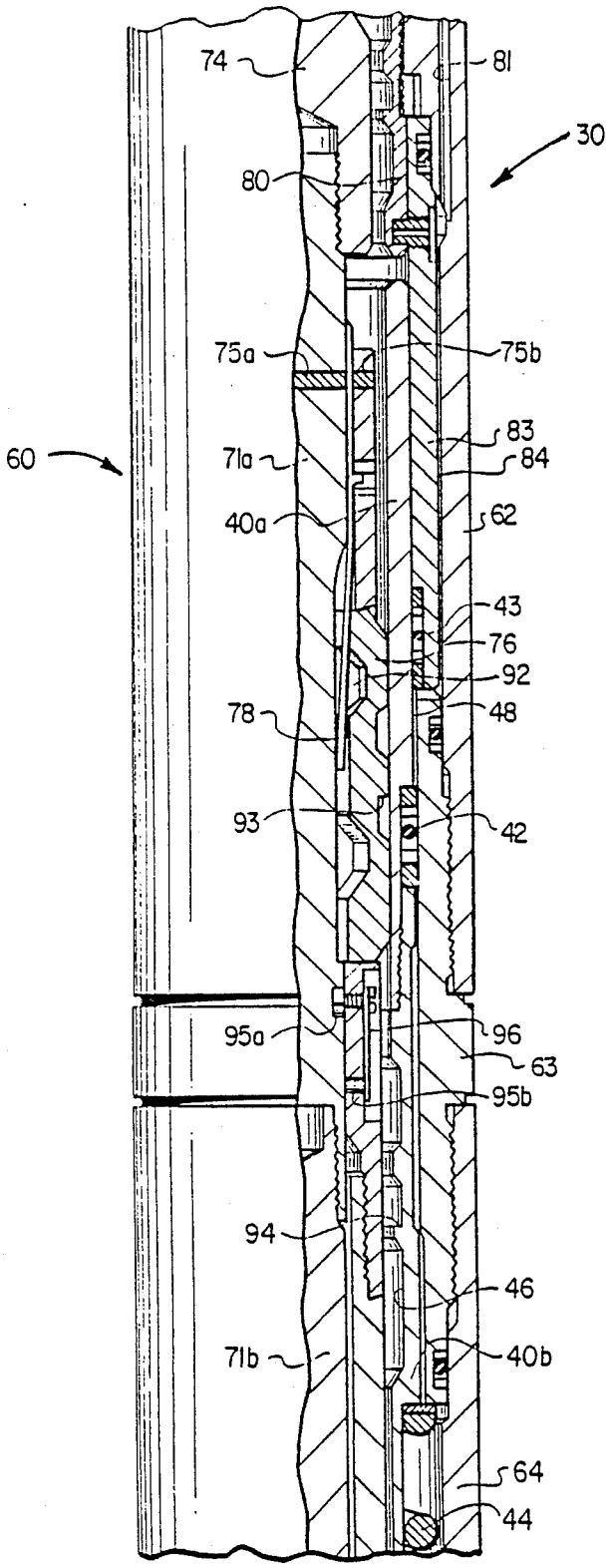
FIGS. 7A, 7B, and 7C taken together form a view similar to FIGS. 6A–C showing the shifting tool released from the operator tube in the safety valve after shifting the lockout sleeve to hold open the valve closure means.
Figure 7B:
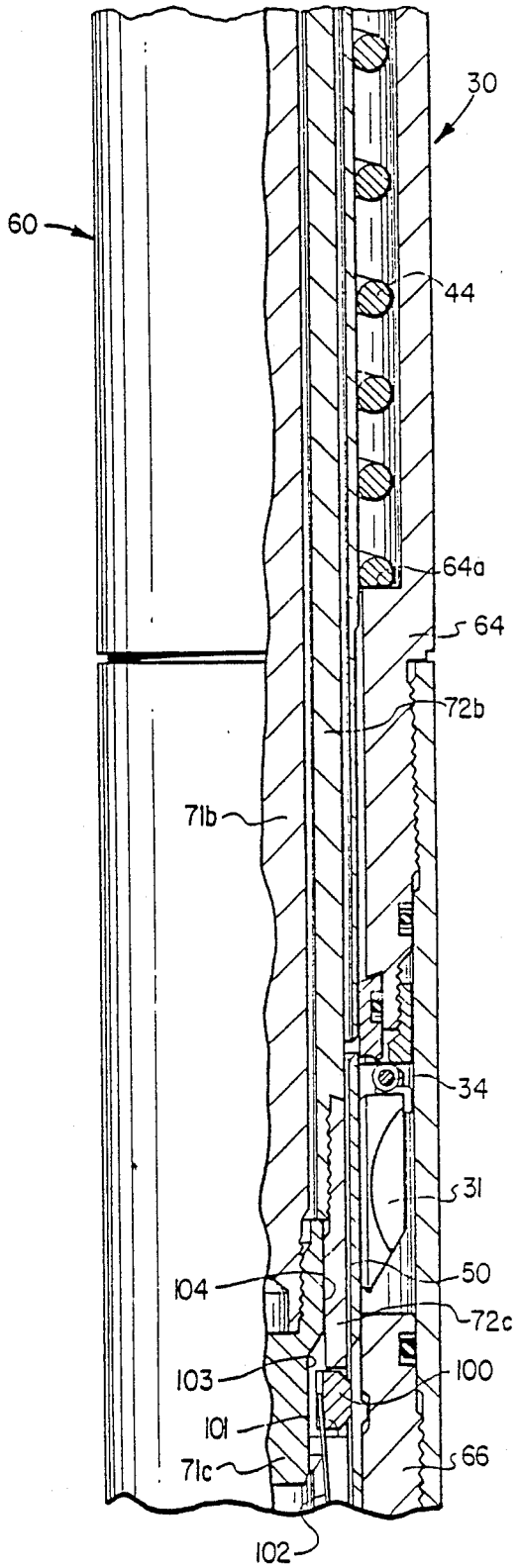
Figure 7C:
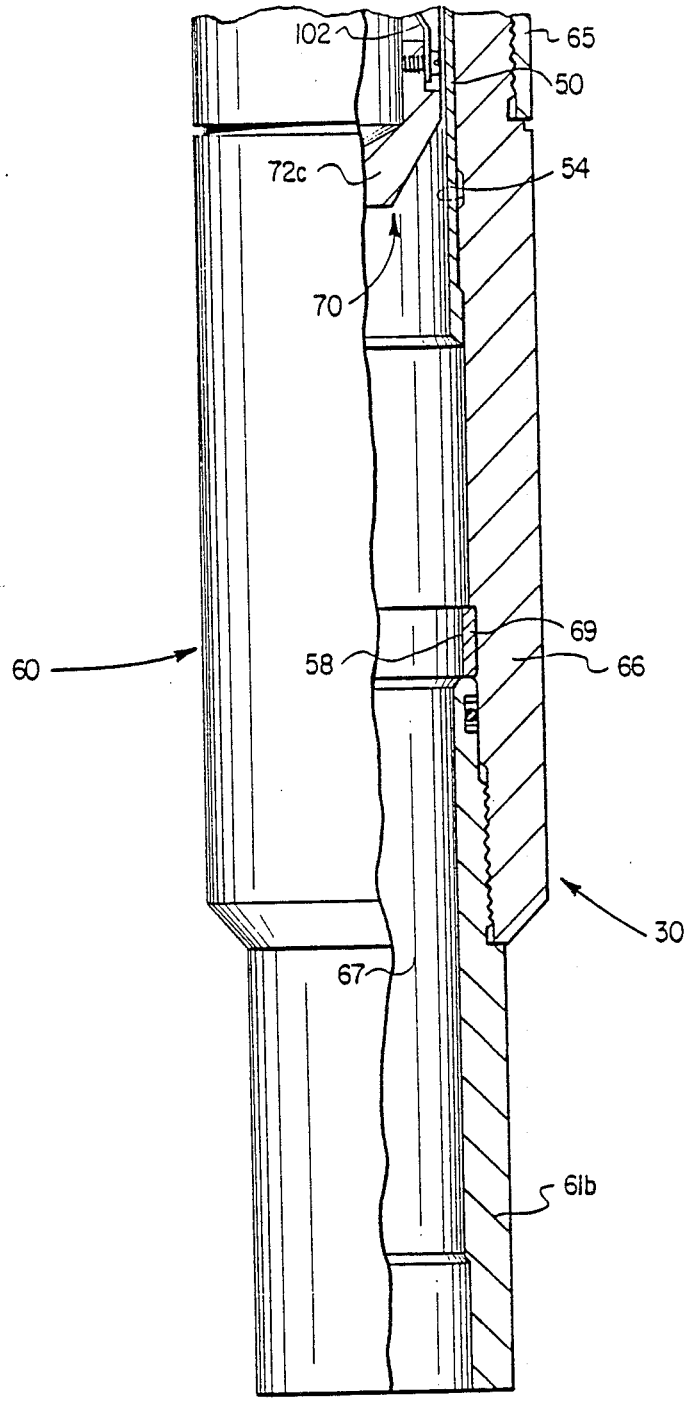

With lockout sleeve 50 in its first position, additional upward force can be applied to fishing neck 74 to shear pin 95 into two pieces 95a and 95b. Inner core means 71 is then free to move to its initial longitudinal position with respect to housing means 72 which allows key 76 and latch dogs 100 to be compressed radially inward. FIGS. 7A and B show shifting tool 70 in this configuration while it is being withdrawn from longitudinal bore 67.

The final result of these operations is shown in FIG. 8. Lockout sleeve 50 is in its first position holding flapper 31 open. Operator tube 40 has been returned to its second position. Shifting tool 70 has been removed from longitudinal bore 67. As previously noted, the smooth uniform inside diameter of lockout sleeve 50 greatly reduces the possibility of wireline service tools accidentally shifting sleeve 50 and returning it to its second position. When the desired well maintenance has been completed, safety valve 30 can be returned to normal operation by simply applying control fluid pressure to chamber 48. This pressure causes operator tube 40 to move to its first position. During this movement, operator tube 40 abuts lockout sleeve 50 and returns sleeve 50 to its second position.

During the initial installation of tubing string 21 within casing 28, lockout sleeve 50 can be used to check the integrity of control line 26 and the proper functioning of safety valve 30. During installation, safety valve 30 is preferably attached to tubing string 21 with valve closure means 31 and lockout sleeve 50 both in their first position. Collet fingers 52, bosses 53 and groove 55 are designed to allow a substantial amount of control fluid pressure to be applied to chamber 48 before operator tube 40 can shift lockout sleeve 50 to its second position. By applying less than this amount of pressure to control line 26 from manifold 25, the integrity of control line 26 can be monitored. A drop in control line pressure or a decrease in control fluid level at manifold 25 indicates a possible leak in control line 26 which should be investigated before completing well 20. After tubing string 21 is properly disposed within casing 28, sufficient pressure can be applied to control line 26 to shift lockout sleeve 50 to its second position. Proper operation of safety valve 30 can be verified by monitoring the control line pressure and volume required for this shifting.

Alternative Embodiments

The previous description has been directed towards an operator tube which opens a flapper type valve closure means. U.S. Pat. No. 3,860,066 to Joseph L. Pearce et al demonstrates that operator tube 40 could be modified to open and close ball type and poppet type valve closure means in addition to flapper 31. Therefore, the present invention is not limited to flapper valves. Shifting tool 170 shown in FIGS. 9A and 9B may be used to cycle any type of valve closure means between its open and closed position as long as the valve operator tube has been modified for releasable engagement with tool 170. Generally, shifting tool 170 will be used to open the valve closure means. However, it could be used to move the operator tube to close the valve closure means if required.

Some components and features of shifting tool 170 are identical to those of shifting tool 70 and will be given the same numerical designation. The principal structural differences between shifting tool 170 and previously described shifting tool 70 are the replacement of fishing neck 74 by equalizing valve and packing assembly 180 and removal of core means subsections 71*b* and *c* and housing means subsections 72*b* and c. The principal operating differences are that equalizing valve and packing assembly 180 allows fluid pressure in tubing string 21 to be applied to operator tube 40 and latching dogs 100 are not provided to shift lockout sleeve 50.

Figure 9A:
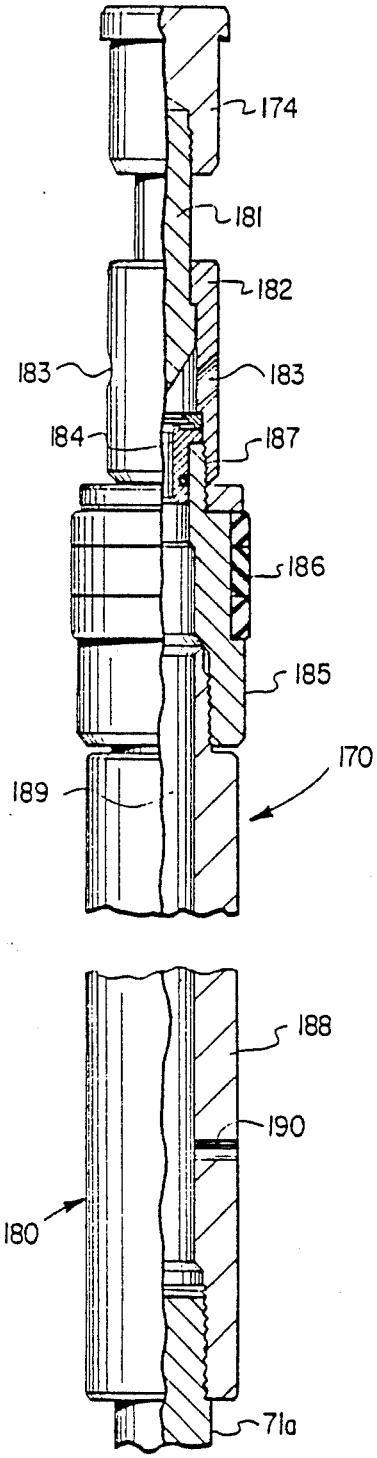
FIGS. 9A and 9B are drawings partially in section and partially in elevation with portions broken away showing an alternative embodiment of the shifting tool.
Figure 9B:
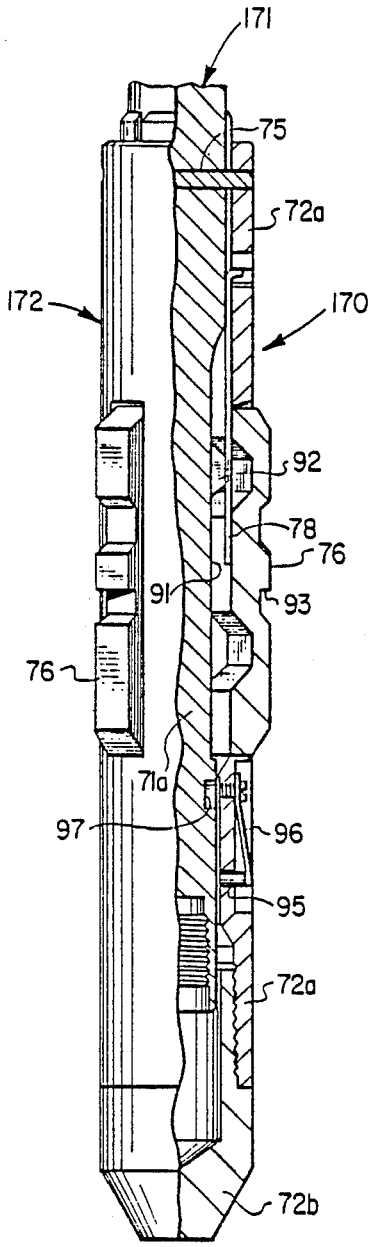

Equalizing valve and packing assembly 180 as shown in FIG. 9A includes fishing neck 174 for attachment to a standard wireline tool string. Fishing neck 174 is connected by threads to poppet valve plunger 181 which is slidably disposed in valve housing 182. Ports 183 communicate fluid between the interior and exterior of valve housing 182. Valve seat 184 is disposed within valve housing 182 for engagement with valve plunger 181.

Packing carrier 185 is attached to valve housing 182 by threads 187. Packing or seal means 186 is carried on the exterior of packing carrier 185. The dimensions of seal means 186 are selected to form a fluid barrier with the inside diameter housing subsection 61*a* when shifting tool 170 is engaged with operator tube 40. A hollow, longitudinal spacer 188 is used to attach packing carrier 185 to core means section 71*a* by suitable threaded connections. Longitudinal flow passageway 189 extends through valve housing 182, packing carrier 185, and spacer 188. Port 190 communicates between the exterior of spacer 188 and longitudinal flow passageway 189.

During installation of shifting tool 170, plunger 181 is spaced longitudinally above valve seat 184 to allow fluid in tubing string 21 to bypass seal means 186. When keys 76 engage profile 46, plunger 181 is lowered to contact valve seat 184 to block fluid flow via longitudinal passageway 189. The length of spacer 188 is preferably selected so that seal means 186 form a fluid barrier with the inside diameter of housing subsection 61*a* immediately below locking recesses 68. Hydraulic fluid pressure can then be applied from the well surface via tubing string 21 to act on seal means 186. Since the effective piston area of seal means 186 is much larger than piston seal means 42 carried by operator tube 40, shifting tool 170 can apply considerably more force to operator tube 40 to open valve closure means 31. This feature may be particularly desirable for ball type valve closure means. Also, spacer 188 could be removed if operator tube 40 is modified to allow seal means 186 to form a fluid barrier therewith.

Shifting tool 170 is released from engagement with operator tube 40 in the same manner as previously described for shifting tool 70. When sufficient upward force is applied to fishing neck 174 to shear pin 95, core means subsection 71*a* will move upward to allow keys 76 to be compressed radially inward.

Figure 10A:
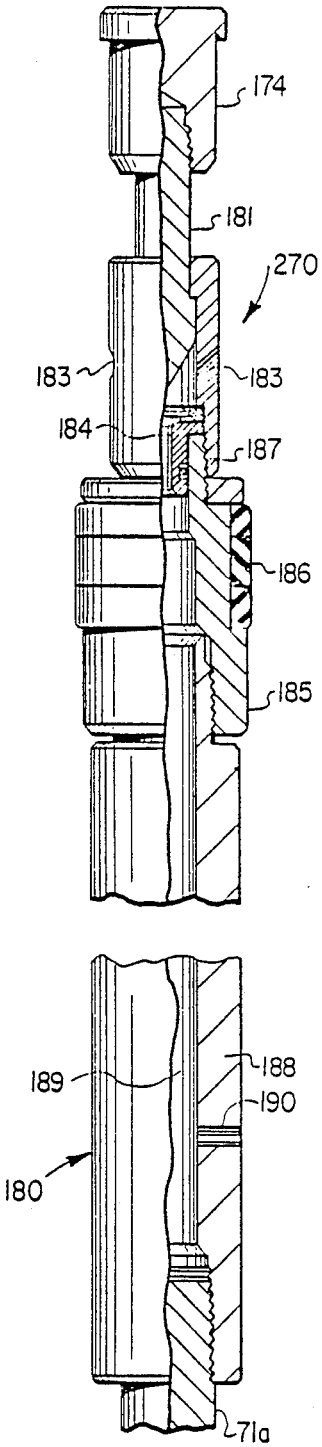
FIGS. 10A and 10B are drawings partially in section and partially in elevation with portions broken away showing another alternative embodiment of the shifting tool.
Figure 10B:
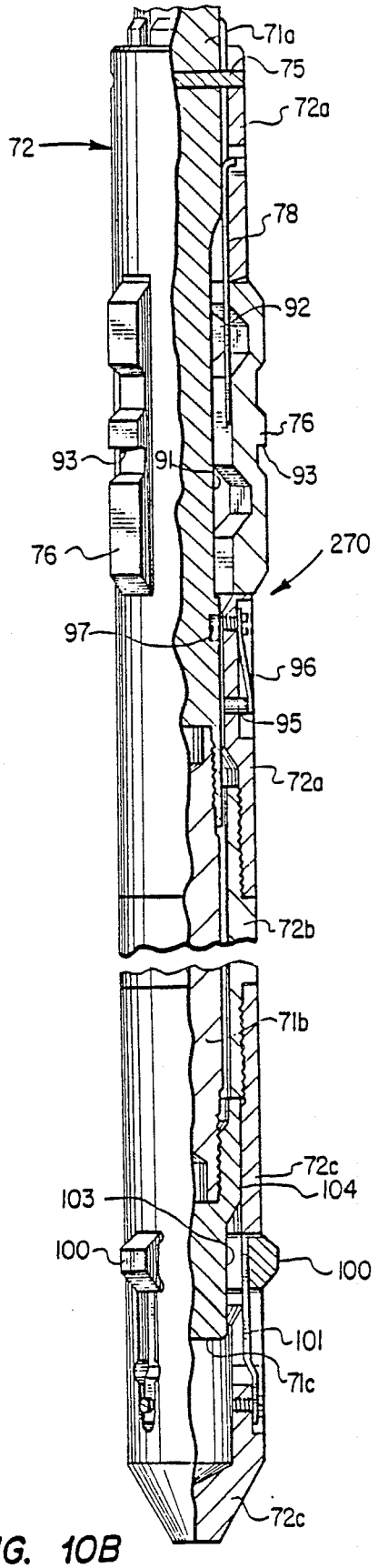

The previous description has also been directed towards a safety valve which is opened and closed in response to a hydraulic fluid control signal from the well surface. The present invention can be used with any type of safety valve control signal including electrically operated valves such as shown in U.S. Pat. No. 3,731,742 to Phillip S. Sizer et al or U.S. Pat. No. 4,002,202 to Louis B. Paulos et al. Another alternative embodiment of the present invention, shifting tool 270 shown in FIGS. 10A and B, allows both opening a safety valve and locking the valve open if desired without regard to the presence of the valve's normal control signal. This embodiment is particularly important as a backup feature for safety valve control systems which use electrical, electronic, sound, electro-hydraulic, hydraulic pilot or similarly sophisticated control systems. During periods when the sophisticated control systems are being repaired, shifting tool 270 allows a safety valve having an operator tube with profile 46 and lockout sleeve 50 to be temporarily locked open without regard to the presence of the normal control signal. A direct acting safety valve would preferably be installed until repair of the control system had been completed. Therefore, the present invention is not limited to hydraulically controlled safety valves and may in fact provide sufficient reliability to make more complicated control systems commercially acceptable for downhole safety valves.

In the event of a serious control line leak, it may not be desirable to use permanent lockout sleeve 80 to shift valve closure means 31 to its first position because formation fluids can then escape via the control line leak. Shifting tool 270 allows valve closure means 31 to be locked open without the use of control fluid pressure and without disturbing permanent lockout sleeve 80. A direct acting safety valve or STORM CHOKE® safety valve which does not require hydraulic control fluid can then be installed within longitudinal flow passageway 67 to maintain well safety. Prior to the present invention, the only solution to a serious control line leak was to remove tubing string 21 from the well bore—a very expensive procedure.

Shifting tool 270 is identical with shifting tool 70 except that fishing neck 74 has been replaced by equalizing valve and packing assembly 180 of shifting tool 170. Shifting tool 270 can use fluid pressure in tubing string 21 to open valve closure means 31 as previously described for shifting tool 170. Shifting tool 270 can be manipulated by a wireline tool string attached to fishing neck 174 to shift lockout sleeve 50 to its first position as previously described for shifting tool 70.

The previous description is illustrative of only some of the embodiments of the invention. Those skilled in the art will readily see other variations for a shifting tool and subsurface safety valve utilizing the present invention. Changes and modifications may be made without departing from the scope of the invention which is defined by the claims.

What is claimed is:

1. A safety valve for downhole use in a well comprising:

a. housing means having a longitudinal bore extending therethrough;

b. valve closure means mounted in the housing means to control fluid flow through the longitudinal bore;

c. the valve closure means having a first position which allows fluid flow through the longitudinal bore and a second position which blocks fluid flow therethrough;

d. an operator tube in the housing means to shift the valve closure means from its second position to its first position;

e. means for moving the operator tube in response to a control signal from the well surface; and f. means for releasably engaging the operator tube with a shifting tool whereby the shifting tool can cycle the valve closure means between its first and second position.

2. A safety valve as defined in claim 1 wherein the releasable engaging means further comprises a profile provided on the interior of the operator tube to receive selective keys on the shifting tool.

3. A safety valve as defined in claim 2 in combination with a shifting tool comprising:

a. the shifting tool adapted for insertion into the longitudinal bore;
b. selective keys on the shifting tool to releasably engage the profile of the operator tube; and
c. means for applying force to the shifting tool to move the operating tube in response thereto.

4. A shifting tool as defined in claim 3 wherein the force applying means comprises seals carried on the exterior of the shifting tool to form a fluid barrier with the, interior of the safety valve whereby fluid pressure can be applied to the shifting tool from the well surface to shift the valve closure means from its second position to its first position.

5. A safety valve for downhole use in a well comprising:
a. housing means having a longitudinal bore extending therethrough;
b. valve closure means mounted in the housing means to control fluid flow through the longitudinal bore;
c. the valve closure means having a first position which allows fluid flow through the longitudinal bore and a second position which blocks fluid flow therethrough; .
d. an operator tube in the housing means to shift the valve closure means from its second position to its first position;
e. means for moving the operator tube in response to a control signal from the well surface;
f. means for releasably engaging the operator tube with a shifting tool whereby the shifting tool can move the operator tube independent of the control signal;
g. the releasable engaging means including a profile on the interior of the operator tube to receive selective keys on the shifting tool;
h. a lockout sleeve in the housing means in tandem with the operator tube;
i. the lockout sleeve having a first position which holds the valve closure means in its first position and a second position which does not restrict movement of the valve closure means between its first and second positions;
j. the lockout sleeve having a relatively uniform inside diameter to prevent accidental shifting of the lockout sleeve by well tools moving through the longitudinal bore; and
k. means for releasably holding the lockout sleeve in either its first position or its second position.

6. A safety valve in accordance with claim 5 wherein the releasable holding means comprises circumferentially spaced longitudinal collet fingers having external bosses and the housing means includes spaced internal grooves for engagement with the bosses on the collet fingers.

7. A safety valve as defined in claim 5 in combination with a shifting tool further comprising:
a. the shifting tool adapted for insertion into the longitudinal bore;
b. selective keys on the shifting tool to releasably engage the profile of the operator tube;
c. latch dogs carried by the shifting tool and spaced longitudinally from the selective keys;
d. the latch dogs sized to abut the lower end of the lockout sleeve when the selective keys are located in the profile of the operator tube; and
e. the shifting tool providing means for moving the lockout sleeve in unison with the operator tube when the selective keys are in the profile and the latch dogs abut the lower end of the lockout sleeve.

8. A safety valve as defined in claim 7 wherein the housing means includes a recess below the lockout sleeve to allow the latch dogs to abut the lower end thereof.

9. A safety valve as defined in claim 8 wherein the shifting tool further comprises seals carried on the exterior of the shifting tool to form a fluid barrier within the safety valve whereby fluid pressure can be applied to the shifting tool from the well surface to shift the valve closure means from its second position to its first position.

10. A surface controlled subsurface tubing supported well safety valve comprising:
a. tubular housing means having a longitudinal bore therethrough and means at opposite ends for connecting the housing means in a well tubing string to form a portion thereof;
b. valve closure means mounted in the housing means to control fluid flow through the longitudinal bore;
c. the valve closure means having a first position which allows fluid flow through the longitudinal bore and a second position which blocks fluid flow therethrough;
d. an operator tube in the housing means to shift the valve closure means from its second position to its first position;
e. an annular piston means on said operator tube for moving the operator tube and valve closure means to their first position;
f. the housing means in combination with the piston means partially defining a control fluid chamber around the piston means;
g. the housing means having passage means to the chamber for conducting control fluid to the chamber to move the operator tube;
h. means for biasing the operator tube in a direction to shift the valve closure means to its second position;
i. means for releasably engaging the operator tube with a shifting tool whereby the shifting tool can move the operator tube independent of the control fluid;
j. the releasable engaging means including a selective key profile provided on the interior of the operator tube;
k. the shifting tool adapted for insertion into the longitudinal bore;
l. selective keys on the shifting tool to releasably engage the profile of the operator tube; and
m. means for applying force to the shifting tool to move the operator tube in response thereto.

11. A surface controlled subsurface tubing supported well safety valve comprising:
a. tubular housing means having a longitudinal bore therethrough and means at opposite ends for connecting the housing means in a well tubing string to form a portion thereof;
b. valve closure means mounted in the housing means to control fluid flow through the longitudinal bore;
c. the valve closure means having a first position which allows fluid flow through the longitudinal bore and a second position which blocks fluid flow therethrough;
d. an operator tube in the housing means to shift the valve closure means from its second position to its first position;

e. an annular piston means on said operator tube for moving the operator tube and valve closure means to their first position;
f. the housing means in combination with the piston means partially defining a control fluid chamber around the piston means;
g. the housing means having passage means to the chamber for conducting control fluid to the chamber to move the operator tube;
h. means for biasing the operator tube in a direction to shift the valve closure means to its second position;
i. means for releasably engaging the operator tube with a shifting tool whereby the shifting tool can move the operator tube independent of the control fluid;
j. the releasable engaging means including a selective key profile provided on the interior of the operator tube;
k. the shifting tool adapted for insertion into the longitudinal bore;
l. selective keys on the shifting tool to releasably engage the profile of the operator tube;
m. means for applying force to the shifting tool to move the operator tube in response thereto;
n. a lockout sleeve in the housing means in tandem with the operator tube;
o. the lockout sleeve having a first position which holds the valve closure means in its first position and a second position which does not restrict movement of the valve closure means between its first and second positions;
p. the lockout sleeve having a relatively uniform inside diameter to prevent accidental shifting of the lockout sleeve by well tools moving through the longitudinal bore; and
g. means for releasably holding the lockout sleeve in either its first position or its second position.

12. A safety valve as defined in claim 11 wherein the shifting tool further comprises:
a. latch dogs carried by the shifting tool and spaced longitudinally from the selective keys;
b. the latch dogs sized to abut the lower end of the lockout sleeve when the selective keys are located in the profile of the operator tube;
c. the shifting tool providing means for moving the lockout sleeve in unison with the operator tube when the selective keys are in the profile and the latch dogs abut the lower end of the lockout sleeve; and
d. a recess below the lockout sleeve to allow the latch dogs to abut the lower end thereof.

13. A shifting tool as defined in claim 12 wherein the force applying means comprises seals carried on the exterior of the shifting tool to form a fluid barrier with the interior of the safety valve whereby fluid pressure can be applied to the shifting tool from the well surface to shift the valve closure means from its second position to its first position.

14. A surface controlled subsurface tubing supported well safety valve comprising:
a. tubular housing means having a longitudinal bore therethrough and means at opposite ends for connecting the housing means in a well tubing string to form a portion thereof;
b. valve closure means mounted in the housing means to control fluid flow through the longitudinal bore;
c. the valve closure means having a first position which allows fluid flow through the longitudinal bore and a second position which blocks fluid flow therethrough;
d. an operator tube in the housing means to shift the valve closure means from its second position to its first position;
e. an annular piston means on said operator tube for moving the operator tube and valve closure means to its first position;
f. the housing means in combination with the piston means partially defining a control fluid chamber around the piston means;
g. the housing means having passage means to said chamber for conducting control fluid to the chamber to move the operator tube;
h. means for biasing the operator tube in a direction to shift the valve closure means to its second position;
i. means for releasably engaging the operator tube with a shifting tool whereby the shifting tool can move the operator tube independent of the control fluid;
j. a lockout sleeve in the housing means in tandem with the operator tube;
k. the lockout sleeve having a first position which holds the valve closure means in its first position and a second position which does not restrict movement of the valve closure means between its first and second positions;
l. the lockout sleeve having a relatively uniform inside diameter to prevent accidental shifting of the lockout sleeve by well tools moving through the longitudinal bore; and
m. means for releasably holding the lockout sleeve in either its first position or its second position.

15. A safety valve as defined in claim 14 in combination with the shifting tool further comprising:
a. the shifting tool adapted for insertion into the longitudinal bore;
b. selective keys on the shifting tool to releasably engage the profile of the operator tube;
c. latch dogs carried by the shifting tool and spaced longitudinally from the selective keys;
d. the latch dogs sized to abut the lower end of the lockout sleeve when the selective keys are located in the profile of the operator tube; and
e. the shifting tool providing means for moving the lockout sleeve in unison with the operator tube when the selective keys are in the profile and the latch dogs abut the lower end of the lockout sleeve.

16. A safety valve as defined in claim 15 wherein the housing means includes a recess below the lockout sleeve to allow the latch dogs to abut the lower end thereof.

17. The method of operating a surface controlled subsurface safety valve having an operator tube and a valve closure means with the safety valve positioned in a tubing string to control fluid flow at a downhole location in a well comprising:
a. inserting a shifting tool into the operator tube from the well surface via the tubing string;
b. releasably engaging the shifting tool with a selective key profile in the interior of the operator tube;
c. forming a fluid barrier within the interior of the safety valve;
d. applying fluid pressure from the well surface to act upon the fluid barrier to shift the operator tube and to open the valve closure means;
e. engaging a lockout sleeve in the safety valve with the shifting tool; and f. moving the lockout sleeve and operator tube in unison to a position whereby the operator sleeve holds the valve closure means open.

18. The method of claim 17 further comprising engagement of selective keys on the shifting tool with the selective profile and latch dogs on the shifting tool abutting the lower end of the lockout sleeve.

19. The method of claim 18 further comprising using a wireline attached to the shifting tool from the well surface to move the operator tube and lockout sleeve in unison to hold open the valve closure means.

20. The method of claim 19 further comprising:

a. removing the shifting tool from within the operator tube; and b. installing a direct acting safety valve at a downhole location in the tubing string.

21. A shifting tool for use in operating a lockout sleeve of a well safety valve comprising:

a. inner core means slidably disposed within a housing means;

b. means for attaching one end of the inner core means to a wireline tool string;

c. first means for releasably engaging the inner core means to the housing means to prevent relative movement therebetween;

d. selective profile keys projecting radially through first windows in the housing means;

e. latch dogs projecting radially through second windows in the housing means and spaced longitudinally from the selective keys;

f. the first releasable means holding the inner core means in its first position which allows compression of the selective keys and latch dogs radially inward; and g. second means for releasably engaging the inner core means to the housing means and holding both the selective keys and the latch dogs radially expanded.

22. The method of operating a surface controlled subsurface safety valve having an operator tube and a valve closure means to cycle the valve closure means between its open and closed positions comprising:

a. inserting a shifting tool into the operator tube from the well surface via the tubing string;

b. releasably engaging the shifting tool with a selective key profile in the interior of the operator tube; and c. applying force to the shifting tool to cycle the valve closure means between its open and closed positions.

* * * * *